United States Patent [19]

Nagai

[11] Patent Number: 5,055,672

[45] Date of Patent: Oct. 8, 1991

[54] FAST ATOM BEAM SOURCE

[75] Inventor: Kazutoshi Nagai, Kanagawa, Japan

[73] Assignee: Ebara Corporation, Tokyo, Japan

[21] Appl. No.: 615,858

[22] Filed: Nov. 20, 1990

[30] Foreign Application Priority Data

Nov. 22, 1989 [JP] Japan ..... 1-301832

[51] Int. Cl.[5] ..... H05H 3/02

[52] U.S. Cl. ..... 250/251

[58] Field of Search ..... 250/251, 423 R, 424, 250/425, 426; 315/111.21

[56] References Cited

U.S. PATENT DOCUMENTS

| | | | |
|---|---|---|---|
| 4,570,066 | 2/1986 | Schlag et al. | 250/251 |
| 4,734,622 | 3/1988 | Stein | 250/251 |
| 4,789,779 | 12/1988 | Drullinger | 250/251 |

OTHER PUBLICATIONS

Nagai, K. and Kuwano, H. "FAB-SIMS Study for Analysis of Insulators", Springer Series in Chemical Physics 36, (Springer-Verlag, 1984) pp. 448-450.

Shimokawa, F. and Nagai, K. "A Low Energy Fast-Atom Source", *Nuclear Instruments and Methods in Physics Research B*33, (198) pp. 867-870, as reprinted from Nuclear Instruments and Methods in Physics Research B.

Nagai, K., "Mass Analysis for Metal and Plastics by a FAB-SIMS/SNMS Apparatus", *Review of the Electrical Communications Laboratories*, vol. 36 No. 6, (1988) pp. 587-592.

*Primary Examiner*—Jack I. Berman
*Assistant Examiner*—Kiet T. Nguyen
*Attorney, Agent, or Firm*—Wenderoth, Lind & Ponack

[57] ABSTRACT

A fast atom beam source comprises a evacuated cylinder, an anode set at one end or an intermediate portion of the cylinder, a cathode with fast atom emission orifices on it, and set at the other end of the cylinder, and a DC high voltage power supply for generating gas discharge by applying a high voltage between the anode and the cathode. A slit is provided on inside wall of the cylinder and a reservoir for oil or low-melting point metal is connected to the slit. A heater is set on the resevoir for vapourizing the oil or low-melting point metal. It supplies vapor of oil or low-melting point metal into the cylinder. Many ions of oil or low melting point metal are generated in glow through gas (the oil, vapor or the metal vapor) discharge by high voltage applying. They are accelerated towards the cathode. Then, they are neutralized after collision with the vapor of oil or low-melting point metal remaining near the cathode and are emitted from the orifices on the cathode. They constitute a fast atom beam. During such operation, the vapor of oil or low-melting point metal enters the cylinder through the slit and maintains an equilibrium condition of gas density in the cylinder. Thus, an automatic supply of the gas consumed as a fast atom beam is effected without any gas feeding device or any gas adjusting device.

12 Claims, 2 Drawing Sheets

FAST ATOM BEAM SOURCE

BACKGROUND OF THE INVENTION

1. Field of the Invention

The present invention relates to a fast atom beam source used for sputtering and the like.

2. Prior Art

Atoms or molecules subject to thermal kinetics in a normal atmosphere have kinetic energy of approximately 0.05 eV. Molecules or atoms moving with kinetic energy remarkably higher than that level are generally known as "fast atoms" and if they flow in one direction as a beam, the beam is called as "a fast atom beam".

Sputtering technology by energetic beam bombardment has been used in sputter etching or material composition analysis. In the technology, an energetic ion beam or a fast atom beam is used as the energetic beam for bombardment.

As a source for a fast atom beam, some apparatuses convert ions emitted from an ion source into fast atoms by neutralization with ion-electron recombination and the other apparatuses emit a fast atom beam directly as shown in FIG. 4.

Concerning the construction of an usual source for a fast atom beam shown in FIG. 4, a doughnut-shaped anode 2 is set at the center of a cylindrical cathode 1. The cathode 1 and the anode 2 are connected to a DC high voltage power supply 3 arranged outside a vacuum vessel. Oxygen gas, for example, is let in through a gas nozzle 4 opening into the inside of the cylindrical cathode 1 and plasma 6 due to gas discharge is generated in the cylindrical cathode 1 by impressing supplying of DC high voltage through the DC high voltage power supply 3, thereby oxygen ions and electrons are produced. Furthermore, the electrons emitted from the cathode 1 are forced to oscillate in high frequency across the anode 2 and produce many oxygen ions by collision with the oxygen gas.

The oxygen ions produced in plasma are accelerated towards the bottom of the cylindrical cathode 1. Then, oxygen ions return to oxygen atoms by neutralization through contact with oxygen gas molecules and by recombination with electrons remaining near the cathode 1.

As a kinetic energy loss through contact with gas molecules and electrons is small, the kinetic energy of the oxygen ions is directly received to the oxygen atoms. Thus fast atoms are born. The fast atoms are emitted as a fast atom beam 8 from the emission orifices 7 provided on the bottom of the cylindrical cathode 1.

A fast atom beam without electric charges may be used for processing or analysis not only for metals and semiconductors but also for plastics and ceramics, etc. to which the workability for an ion beam is poor.

In the above-mentioned fast atom beam source, however, the gas should always be supplied to the apparatus in order to make up the material emitted as a fast atom beam.

Therefore, it is required to provide a device for supplying the gas from the outside of the vacuum vessel, and the apparatus will be of a large size.

In addition, it is not desirable for a high vacuum equipment to let in some gas. Further, it will be required to provide some devices for adjusting the feed rate of the gas in order to keep a discharge condition in the fast atom beam source.

SUMMARY OF THE INVENTION

It is, therefore, the object of the present invention to solve the above problems by providing a fast atom beam source which is of a small size and is capable of fast atom beam emission without vacuum deterioration by using easily liquefied gas.

The above-mentioned object of the invention is attained by a fast atom beam source comprising:

- an evacuated cylinder on the inside wall of which a slit is opened;
- a reservoir for oil or low-melting point metal connected to the said slit;
- a heater arranged on the said reservoir for vaporizing the said oil or low-melting point metal;
- a cooling member arranged outside the said cylinder for returning the vapor of the oil or the low-melting point metal to liquid; and
- a DC high voltage power supply generating gas discharge by applying a high voltage between an anode set at one end or an intermediate portion of the said cylinder and a cathode with fast atom emission orifices on it and at the other end of the said cylinder.

The reservoir is connected to the slit. An oil or a low melting point metal in the reservoir is vaporized by a heater, and the vapor of the oil or the low-melting point metal fills the cylinder. By applying of a high voltage through a DC high voltage power supply, a gas discharge is generated in the cylinder and the vapor is ionized in the plasma. Then ions are accelerated towards the cathode. They are neutralized through contact with the vapor molecules remaining near the cathode and resultingly being emitted as a fast atom beam. While the vapor molecule density is reduced by emission of the fast atom beam, the apparatus operates such that the vapor is supplied from the reservoir.

Therefore, it is not necessary to provide some devices for introducing the gas from the outside of the apparatus or devices for adjusting the feed rate of the gas, so that it is possible to make an source of a small size.

In addition, the reduction in vacuum level of some equipments for sputter technology with the fast atom beam source can be minimized, as the vapor in the source circulates between the reservoir and the cylinder through evapolating by heating and liquefaction by cooling with little loss of the vapor to the outside of the cylinder.

The above and other objects, features and advantages of the present invention will become more apparent from the following description when taken in conjunction with the accompanying drawings in which a preferred embodiment of the present invention is shown by way of illustrative examples.

DETAILED DESCRIPTION OF THE PREFERRED EMBODIMENTS

Figure 1:
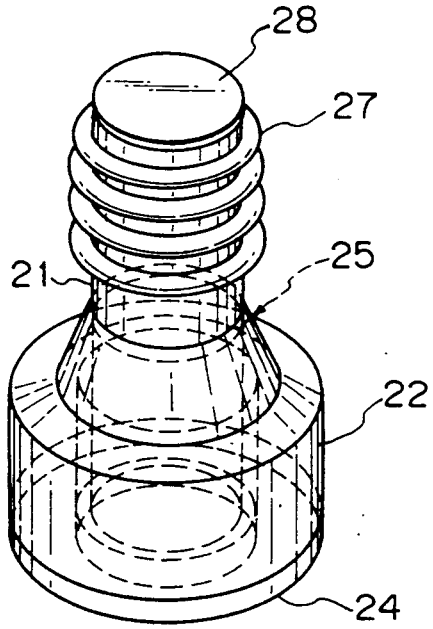
FIG. 1 is a schematic perspective view showing an embodiment of the fast atom beam source of the present invention.
Figure 2:
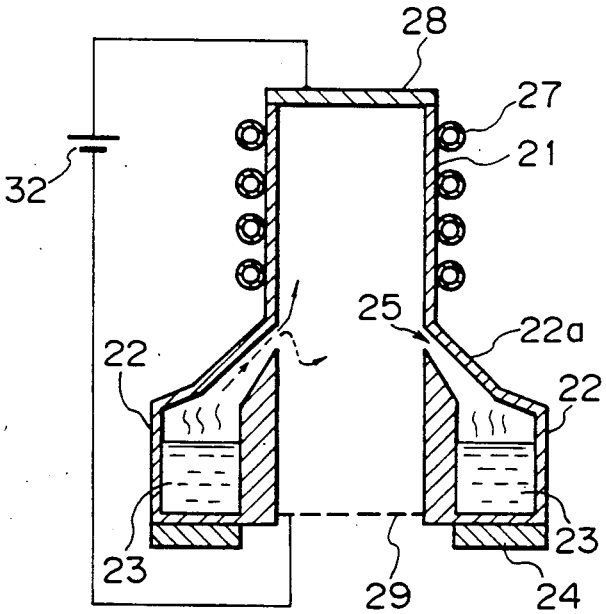
FIG. 2 is a vertical cross-sectional view of the apparatus shown in FIG. 1.

The preferred embodiments of the present invention will be described in accordance with the attached drawings. FIG. 1 is a schematic perspective view showing an embodiment of the fast atom beam source of the present invention and FIG. 2 is a vertical cross-sectional view of the apparatus shown in FIG. 1.

At the center in the longitudinal direction of an evacuated cylinder 21, a slit 25 is opened along the total periphery of the cylinder and a doughnut-shaped reservoir 22 totally surrounding the lower part of the vertically positioned cylinder 21 is connected to the slit 25 by means of the inclined wall 22*a*. An oil or a low-melting point metal 23 is accumulated in the reservoir 22 and, furthermore, a heater 24 is provided on the bottom of the reservoir 22 and a cooling tube 27 surrounds the wall of the cylinder 21 above the slit 25.

At the lower end of the cylinder 21, a cathode 29 with fast atom emission orifices is set and a plate-shaped anode 28 is set at the upper end of the cylinder 21. A DC high voltage power supply 32 is connected to the anode 28 and the cathode 29. The parts except the DC high voltage power supply 32 are located in a vacuum vessel. It is not always necessary for the anode 28 to be closely attached to the cylinder 21.

Furthermore, it is possible to use a variety of materials such as metals and ceramics, etc. as the materials of the cylinder 21. Now, the operation of the present invention will be described.

The oil or the low-melting point metal 23 in the reservoir 22 is hardly vaporized at a cold state before the operation of the apparatus. When the reservoir 22, then, is heated to a predetermined temperature by operation of the heater 24, the oil or the low-melting point metal 23 vaporizes into the cylinder 21.

When a high voltage is, then, applied by the DC high voltage power supply 32, glow by gas discharge is generated between the cathode 29 and the anode 28. The vapor of the oil or the low-melting point metal is ionized in the glow. These ions are accelerated with a high speed towards the cathode 29. Then, they are neutralized through collision with neutral oil or low-melting point metal vapor remaining near the cathode 29 and are emitted from the fast atom emission orifices on the cathode 29.

Though the vapor density decreases because of fast atom emission from the cylinder 21, it is automatically supplied by evaporation from the reservoir 22. Thus, the emission of constant amount of the fast atom beam can be effected.

The vapor of the oil or the low-melting point metal returns to liquid on the wall of the cylinder 21, which is cooled by the cooling tube 27. The liquid oil or the liquid low melting point metal 23 turns back to the reservoir 22 through the slit 25. Thus the vapor in the source circulates between the reservoir 22 and the cylinder 21.

Figure 3:
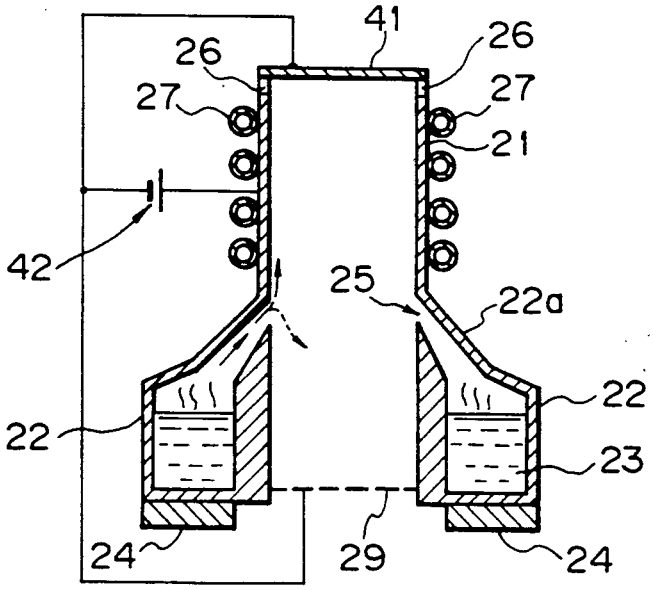
FIG. 3 is a vertical cross-sectional view showing another embodiment of the present invention.
Figure 4:
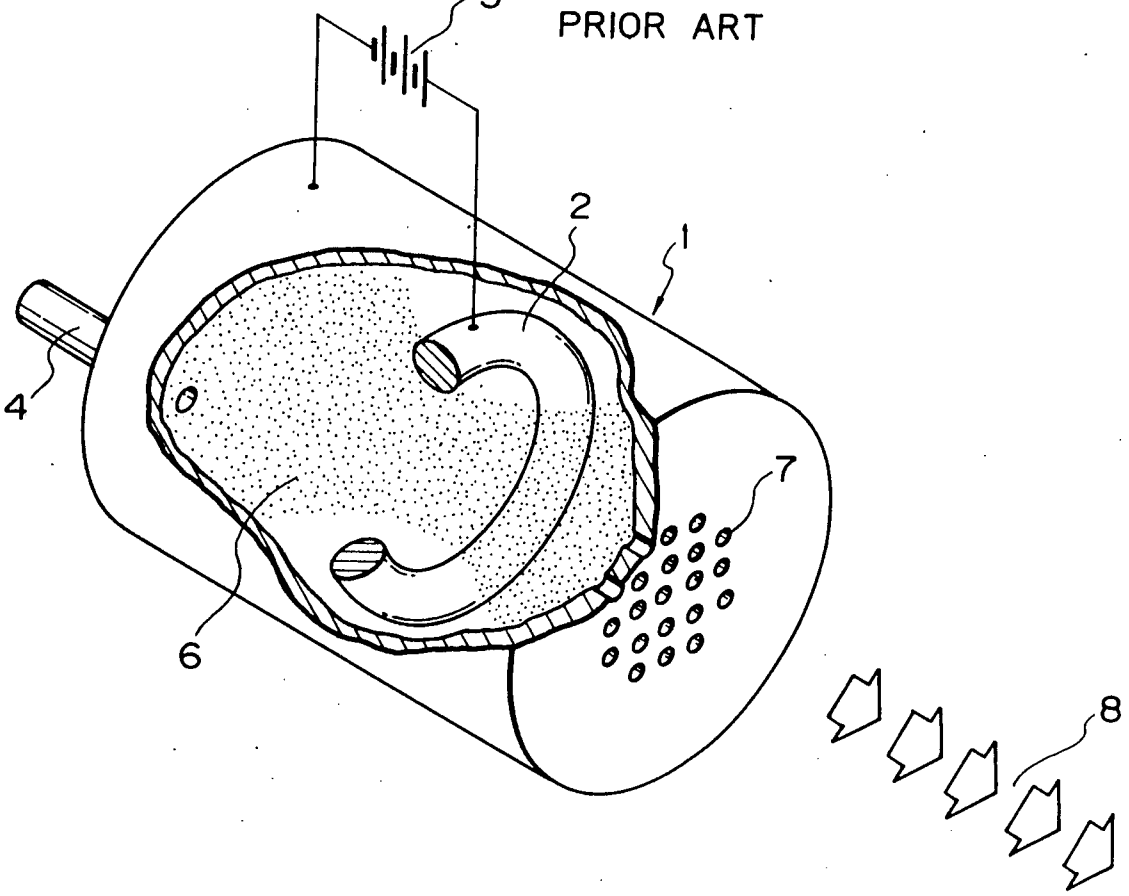
Fig. 4 PRIOR ART
FIG. 4 is a schematic perspective view showing a prior fast atom beam source.

FIG. 3 is a schematic cross-sectional view showing another embodiment of the invention. Herein, the same elements as FIG. 1 and FIG. 2 are given the same symbol.

In this fast atom beam source, the cylinder 21 and the reservoir 22 work as an anode made of metals (only the cylinder 21 may be made of metals) and a plate-shaped cathode 41 is set away from the upper end of the cylinder 21 with insulator spacers 26. Furthermore, the cathode 29 is arranged in the same way as in FIG. 1 and FIG. 2 and the DC high voltage power supply 42 is connected between the cylinder 21 and the cathodes 29, 41.

Though there is difference in gas discharge mode between the cases of the previously described embodiment and this embodiment, the operation itself is almost the same and a fast atom beam is emitted from the fast atom emission orifices on the cathode 29.

As above-mentioned, according to the fast atom beam source of the present invention, there is no necessity of providing any gas-feeding devices or any gas adjusting devices.

It enables to make the apparatus totally in small-sized. Furthermore, the system of vapor circulation in the source with little loss of the vapor to the outside of the cylinder can minimize the reduction of vacuum level in equipments with this source. That is, operation under high-vacuum conditions can be realized.

What is claimed is:

1. A fast atom beam source comprising:

an evacuated cylinder on the inside wall of which a slit is opened;

a reservoir for oil or low-melting point metal connected to said slit;

a heater arranged on said reservoir for vapourizing said oil or low-melting point metal;

a cooling member arranged outside said cylinder for returning the vapor of the oil or the low-melting point metal to liquid; and a DC high voltage power supply generating gas discharge by applying a high voltage between an anode set at one end or an intermediate portion of said cylinder and a cathode with fast atom emission orifices on it and set at the other end of said cylinder.

2. A fast atom beam source claimed in claim 1, wherein said slit is provided along total periphery of the inner surface of the wall of said cylinder.

3. A fast atom beam claimed in claim 1, wherein said anode is plate-shaped and set at an opened end at said cylinder.

4. A fast atom beam claimed in claim 3, wherein said plate-shaped anode is closely attached to said opened end of the said cylinder.

5. A fast atom beam source claimed in claim 1, wherein said cylinder is made of metals or ceramics.

6. A fast atom beam source claimed in claim 1, wherein said cylinder is worked as an anode, a plate shaped cathode with fast atom emission orifices on it is at an opened end of said cylinder, and said DC high voltage power supply is connected between said plate-shaped cathode and said anode formed by said cylinder.

7. A fast atom beam source claimed in claim 6, wherein said cylinder and said reservoir are made of metals.

8. A fast atom beam source claimed in claim 6, wherein the plate-shaped cathode is set away from the opened end of said cylinder with insulator spacers.

9. A fast atom beam claimed in claim 2, wherein said slit is provided at central portion in the longitudinal direction in said cylinder.

10. A fast atom beam source claimed in claim 9, wherein said reservoir is a doughnut-shaped one totally surrounding the lower part of said cylinder and is connected to said slit by means of an inclined wall.

11. A fast atom beam source claimed in claim 10, wherein said heater is provided on the bottom of said reservoir.

12. A fast atom beam source claimed in claim 1, wherein every element except said DC high voltage power supply is arranged in vacuum.

* * * * *